US005983888A

United States Patent [19]

Anselmino et al.

[11] Patent Number: 5,983,888

[45] Date of Patent: Nov. 16, 1999

[54] LOW NOISE COOKER HOOD

[75] Inventors: Jeffery John Anselmino; Guolian Wu, both of St. Joseph, Mich.

[73] Assignee: Whirlpool Corporation, Benton Harbor, Mich.

[21] Appl. No.: 09/287,649

[22] Filed: Apr. 7, 1999

[51] Int. Cl.[6] ..... F24C 15/20

[52] U.S. Cl. ..... 126/299 R; 126/299 D; 454/906; 454/67

[58] Field of Search ..... 126/299 R, 299 D, 126/301, 302, 312, 307 R, 299 F; 181/224; 454/906, 67; 431/114

[56] References Cited

U.S. PATENT DOCUMENTS

| | | | |
|---|---|---|---|
| 2,704,504 | 3/1955 | Wilkening | 98/87 |
| 3,330,379 | 7/1967 | Cook | 454/906 |
| 3,452,667 | 7/1969 | Coleman et al. | 98/41 |
| 3,841,434 | 10/1974 | Culpepper, Jr. | 126/299 D |
| 4,330,047 | 5/1982 | Ruspa et al. | 181/224 |
| 4,877,106 | 10/1989 | Neville et al. | 181/224 |
| 5,326,317 | 7/1994 | Ishizu et al. | 181/224 |
| 5,720,274 | 2/1998 | Brunner et al. | 126/299 |
| 5,738,083 | 4/1998 | Pettinari | 126/299 |
| 5,803,072 | 9/1998 | Strand | 126/299 |

*Primary Examiner*—James C. Yeung
*Attorney, Agent, or Firm*—Joel M. Van Winkle; Robert O. Rice; Stephen D. Krefman

[57] ABSTRACT

A low noise hood is provided having a housing with an air inlet and an air outlet. A first modular device in the form of an intake muffler with a first air duct passage extending therethrough is mounted within the housing near the air inlet. A second modular device in the form of a discharge muffler with a second air duct passage extending therethrough is mounted within the housing near the air outlet. The second air duct passage is shaped to prevent a straight unobstructed passage for air flow through the second passage. A third device comprising an air moving device is secured by a mounting arrangement within the housing. A first vibration isolator such as a plastic saddle is provided in the mounting arrangement for the air moving device for absorbing vibrations and a second vibration isolator in the form of a flexible connector is positioned between the air moving device and the second air duct passage. A third vibration isolator in a mounting arrangement for the discharge muffler may also be used.

27 Claims, 4 Drawing Sheets

LOW NOISE COOKER HOOD

BACKGROUND OF THE INVENTION

The present invention relates to an exhaust hood and more particularly to an exhaust hood having a reduced noise level for use with a cooking appliance.

Exhaust hoods are used in a wide variety of environments including in kitchens to exhaust or filter cooking vapors and fumes, bathrooms, laboratories and other environments where various gases and vapors need to be exhausted from an enclosed space, or treated or filtered and returned to the enclosed space.

Typically the exhaust hoods include some type of air moving device, generally a fan or blower. Preferably the fan or blower will be sufficiently large so as to provide a desired rate of air flow through the hood in order to provide the desired level of exhausting or treating of the air within the enclosed space. However, oftentimes the operation of the air moving device, particularly at higher levels of air movement, creates a noise level which may range from irritating to disruptive.

Attempts have been made in the past to provide exhaust hoods with various features to reduce the noise level produced by operating the exhaust hood. For example, U.S. Pat. No. 5,720,274 discloses a vapor exhaust hood which includes sound absorbing material on various surfaces within the exhaust hood and an elastic mounting of the fan and/or fan motor.

U.S. Pat. No. 5,326,317 discloses an exhaust blower having a "soundproof" unit on the inlet side of the blower to reduce the level of noise generated by the blower which would otherwise be transmitted through the inlet.

U.S. Pat. No. 4,877,106 discloses a noise attenuating assembly arranged at an exhaust opening of an air conditioner to deflect and absorb line-of-sight sound produced by the air conditioner fan.

U.S. Pat. No. 3,452,677 discloses the use of a baffle and various sound absorbing materials within an air outlet passage from an air conditioning system.

U.S. Pat. Nos. 4,330,047 and 2,704,504 disclose various sound-attenuating louvers and air passages to be used in conjunction with air flow from one space to another.

SUMMARY OF THE INVENTION

The present invention provides a hood which may be constructed in modular fashion and which includes a housing having an air inlet and an air outlet. The hood can be provided as either an exhausting type of hood wherein air from the enclosed space is exhausted out of the enclosed space, or as a recirculating hood wherein air from the enclosed space is treated within the hood and returned to the enclosed space.

In either event, the hood includes a housing to receive various components, the components preferably being provided as modular devices. A first modular device in the form of an intake muffler, with a first air duct passage extending therethrough, is mounted within the housing near the air inlet. The first modular device may comprise an air passage shaped to prevent a straight unobstructed path through the passage such that sound waves emanating from a noise source within the hood can not freely exit through the air inlet along a straight path. For example, the first air duct passage could include vibration absorbing materials therein, with the passage largely open, but including at least one bend to prevent a straight through path such that noise exiting the hood in the form of sound waves must travel around the at least one bend.

A second modular device in the form of a discharge muffler is provided with a second air duct passage extending therethrough, mounted within the housing near the air outlet. The second air duct passage should be shaped to prevent a straight unobstructed path through the second passage such that sound waves emanating from a noise source within the hood can not freely exit through the air outlet along a straight path. The second air duct passage could include vibration absorbing materials therein and could comprise a single passageway having a plurality of bends therein. Alternatively, the second air duct passage could comprise a plurality of passages, each having at least one bend therein to prevent a straight line passage from one end to the other.

A third modular device is provided within the housing comprising an air moving device secured by a mounting arrangement within the housing. A first vibration isolator is provided in the mounting arrangement for the air moving device. As an example, the first vibration isolator could comprise a vibration absorbing material positioned between the air moving device and the second modular device when the air moving device is mounted to the second modular device. In an embodiment, the vibration absorbing material comprises a plastic sheet forming a saddle for carrying and supporting the air moving device from the second modular device.

A second vibration isolator can be positioned between the air moving device and the second air duct passage. For example, the second vibration isolator could comprise a flexible material forming a portion of the second air flow passage.

In some embodiments, a third vibration isolator may be provided between the second modular device and the housing. For example, the third vibration isolator could comprise a resilient material in a mounting arrangement between the second modular device and the housing.

When the invention is embodied in a recirculating type hood, preferably there is an exhaust outlet exposed to the enclosed space, which comprises a relatively large open area, in order to reduce a pressure drop through the outlet.

Thus, the invention provides a method and apparatus for directing exhaust in an air stream through a housing having an air inlet and an air outlet with an air moving device positioned between the inlet and outlet. The air stream is directed through a first air passage in a manner to substantially reduce a transmission of sound from the air moving device to the inlet. The air stream is also directed through a second air passage from the air moving device to the air outlet so as to substantially reduce a transmission of sound to the outlet. The invention provides for absorbing sound vibrations carried by the air stream as it flows through the second passage and for substantially reducing transmission of sound vibrations carried by the air stream as it flows through the first passage. Also, the present invention provides for absorbing vibration between the housing and the air moving device and for absorbing vibration between the air moving device and the second passage. The air passages are to be constructed in a manner and operated in a manner so as to provide a minimal air pressure drop through the air passage in order to permit the air moving device to operate more efficiently and at a lower speed, wherein the generation of vibrations is reduced.

DETAILED DESCRIPTION OF THE PREFERRED EMBODIMENTS

Figure 1:
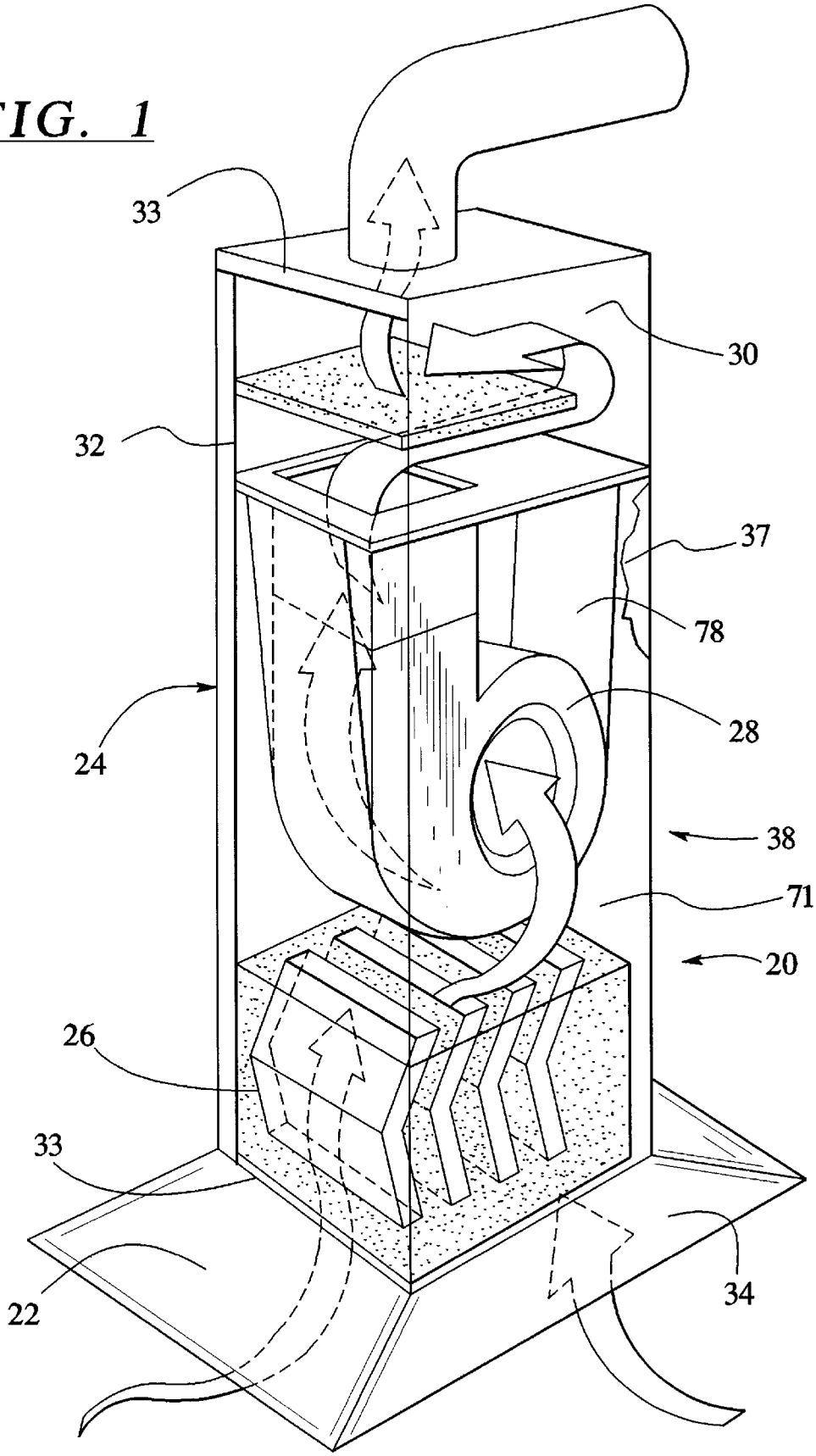
FIG. 1 is a side perspective view of a first embodiment of a hood embodying the principles of the present invention.

In FIG. 1 there is illustrated a hood 20 which, in a preferred embodiment, is used to exhaust heat, vapors and gases generated from a cooking appliance (not shown). Such an environment, of course, is not the only environment in which a hood embodying the principles of the present invention could be utilized in that there are other environments wherein an enclosed space requires the air within that space to be exhausted or re-circulated due to heat, vapor, particulates or other materials in the air which are desired to be removed from the enclosed space. Nevertheless, the present invention will be described in the environment of a cooking appliance in order for a specific embodiment to be described in detail.

The hood 20 includes a lower air collecting skirt portion 22 and a chimney portion 24.

In a preferred embodiment, the exhaust type hood 20 is formed in a modular construction in which there is an intake muffler 26, an air moving device 28 and a discharge muffler 30 comprising the main modular components.

Figure 2:
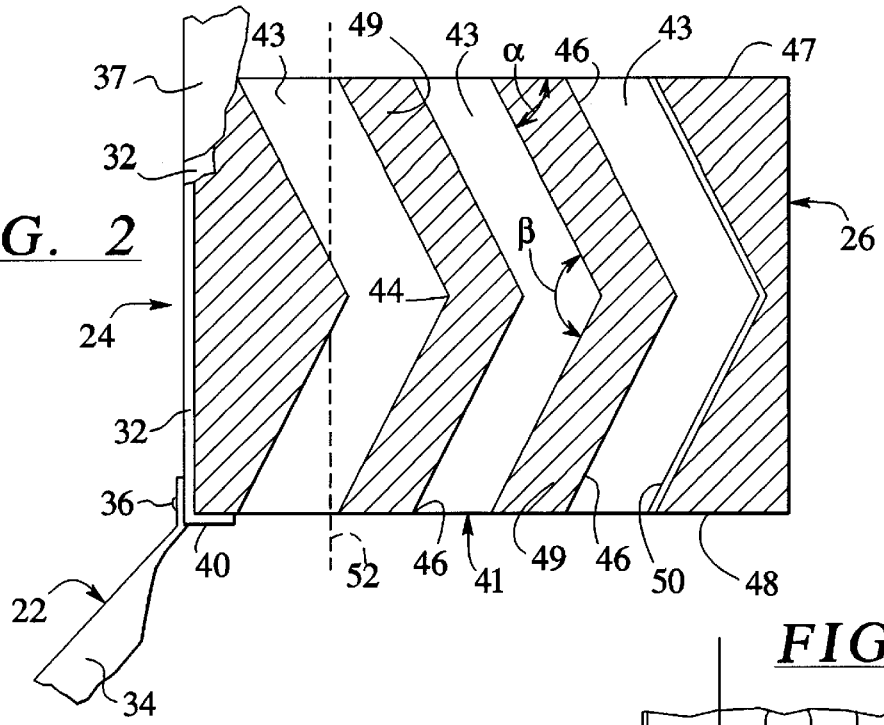
FIG. 2 is a side sectional view of a first modular element of the hood of FIG. 1.

The chimney portion 24 may be constructed of four long pieces 32 of 1" aluminum angle material connected at both ends by a 1" flat aluminum stock 33 in order to provide a framework for the chimney. The skirt portion 22 can be formed by stainless steel sheet 34 and can be attached to the chimney framework by screws or other appropriate fasteners 36 (FIG. 2). A stainless steel sheet 37 can be used to cover the framework structure of the chimney 24 to provide an enclosed housing 38 for the modular components.

As best seen in FIG. 2, the intake muffler 26 preferably is a self contained unit that can be inserted into the chimney framework to rest on a flange 40 formed at the bottom of the chimney framework 24 or at the top of the skirt portion 22. At least one air passageway 41 is provided through the intake muffler 26. The choice of the air passageway geometry is a trade off between air pressure drop and sound absorption effectiveness. Since the air moving device 28 is the noise generator in the hood 20 it is preferred to have the lowest pressure drop as possible through the muffler 26 as possible in order to reduce the demands on the air moving device 28. By reducing the pressure drop, the load on the air moving device 28 is lowered, which reduces the speed at which the air moving device must operate, which in turn reduces the noise generated by the air moving device.

On the other hand, it is preferred to have the greatest sound absorption effectiveness occurring at the intake muffler 26 in order to absorb or prevent the transmission of vibrations and other sound wave energy from the air moving device 28 through the intake muffler 26 to the environment of the enclosed space. In order to achieve this good sound absorption, it is important that the sound waves reflect off of as many sound absorbing surfaces as possible. However, for a low pressure drop, a straight, unobstructed flow path is best. Thus, a comprise between a straight unobstructed flow path and maximizing reflections must be achieved. In a preferred embodiment, the comprise solution has been determined to be a plurality of narrow channels 43 arranged in parallel that each have at least one bend 44 therein, such that there is no line-of-sight passage for the sound to travel from the sound generating air moving device 28 to the enclosed space.

In a specific embodiment reduced to practice by Applicants, the intake muffler 26 was constructed having width and depth dimensions of 10.75" and a height dimension of 9". Three parallel air flow channels 43 were provided through the muffler, with each channel having an opening 46 of 2.5" by 9.75" in top 47 and bottom 48 faces of the muffler. Each channel is arranged at an angle $\alpha$ of 66° with respect to the top 47 and bottom 48 faces of the muffler 26, hence having a bend angle $\beta$ in a center of the air flow channel 43 of 132°. Walls 49 forming the channels 40 are formed of sound absorbing material, such as fiberglass which is held in place by a perforated sheet metal or screen material 50. Preferably the sound absorbing material positioned between the passages is sufficiently thick so as to absorb sound and vibrations traveling through the passageways. For example, the thickness of the walls 49 between the channels 43 could be on the order of 1" thick. The sidewall thicknesses vary in view of the angle of the channels 43 and could range between 0 and 2" thick along their height.

In any event, the angles and lengths of the channels 43 are arranged such that a line-of-sight path through the channel 43 is prevented as indicated by dashed line 52.

Figure 3:
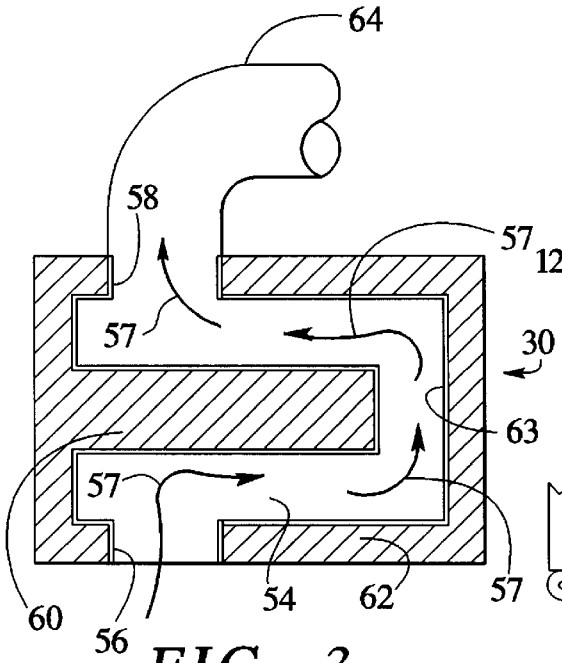
FIG. 3 is a side sectional view of a second modular element of the hood of FIG. 1.

The discharge muffler 30 (shown in greater detail in FIG. 3), in a preferred embodiment, comprises a modular self contained unit. Again, it is preferred to have the smallest possible pressure drop through the discharge muffler and as great a reflection of sound waves off of as many sound absorbing surfaces as possible through the discharge muffler. The discharge muffler 30 may be constructed differently than the intake muffler 26 due to space considerations. That is, the muffler 30 shown in FIG. 3 is designed to fit into a smaller vertical dimension. In this muffler 30 there is a passageway 54 which enters the muffler at an inlet 56 and passes through the interior of the muffler 30, through a series of bends 57, and exits at an outlet opening 58. A baffle 60 is provided intermediate the inlet 56 and outlet 58 in order to cause the air flow through the muffler 30 to follow a non-linear path. Again, line-of-sight communication between the inlet 56 and outlet 58 is avoided.

Also, preferably, all of the surfaces that form the passageway 54 have a sound absorbing material 62 thereon and may be covered with a restraining element 63 such as perforated sheet metal, a screening material, or even a thin plastic material. Due to its very small mass, the thin plastic would be acoustically transparent to sound and would allow sound waves to reach the sound absorbing material 62 to be absorbed. The thin plastic 63 would also reduce the possibility of grease or moisture accumulating in the muffler 30. As an alternative, a sound absorbing foam material could be applied to the interior of the muffler to form the passageway 54.

Attached to the outlet 58 is an exhaust conduit 64 which leads to a space exterior of the enclosed space.

Figure 4:
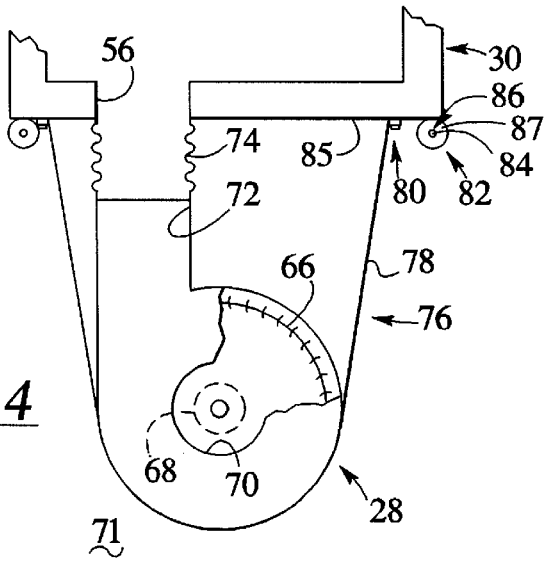
FIG. 4 is a side sectional view of a third modular element of the hood of FIG. 1.

The air moving device 28 (shown in detail in FIG. 4) is preferably a separate modular complete unit comprising a fan or blower 66 and an electric motor 68. The blower has an air inlet 70 which is opened to an interior space 71 within the chimney area 24 and has an air outlet 72 connected to the inlet opening 56 of the discharge muffler 30 by way of a flexible connector 74. For example, the flexible connector 74 could be a flexible cloth fabric used to make an air tight connection between the blower outlet opening 72 and the discharge muffler inlet opening 56.

The air moving device 28 preferably is mounted to the discharge muffler 30 through a mounting arrangement including a vibration isolator 76. In a specific example, the vibration isolator 76 could comprise a saddle support 78 made of polypropylene sheet material which is sufficiently flexible and resilient so as to absorb a substantial amount of the vibrations generated by the air moving device and from preventing them from being transmitted to the discharge muffler 30. The polypropylene sheet 78 can be attached to a bottom of the discharge muffler through an appropriate mounting arrangement 80, such as threaded fasteners or through the use of a strip extending along the width of the polypropylene sheet which is attached to the discharge muffler 30 and which sandwiches the sheet 78 between the strip and the muffler. The saddle support 78 may alternatively be attached to the chimney housing, however, by attaching it to the discharge muffler 30, vibrations can be further attenuated through the discharge muffler 30.

Also, the saddle 78 should be dimensioned, relative to the flexible connector 74, such that the flexible connector 74 loosely connects the outlet 72 of the air moving device 28 to the inlet 56 of the discharge muffler 30. In this manner, vibrations will not be transmitted through the flexible connector 74, unlike the situation if the flexible connector were taut.

Thus, preferably the discharge muffler 30 and attached air moving device 28 are assembled to the chimney portion 24 as a single unit. The discharge muffler 30 can be attached to the chimney portion 24 by a suitable mounting arrangement 82. One particular mounting arrangement would be to provide two rods 84 which extend through the aluminum angle 32 of the chimney portion 24 and on which a bottom wall 85 of the discharge muffler 30 would rest. To further isolate vibrations and prevent vibrations from being transmitted to the chimney portion 24, a third vibration isolator 86 may be positioned between the discharge muffler 30 and the housing. For example, if rods 84 are used as the mounting arrangement, the third vibration isolator 86 may comprise grommets 87 formed of a flexible and resilient material, such as rubber or soft plastic, which can be carried on the rods 84 so that the discharge muffler 30 would actually rest on the grommets rather than the rods. Thus, the grommets 87 would serve as vibration isolators and would substantially absorb any vibrations from the discharge muffler 30 and would prevent them from being transmitted to the housing of the chimney.

Other alternative mounting arrangements could be utilized including appropriate flanges and gaskets, springs or other similar vibration absorbing mounting arrangements.

Thus, with respect to this hood 20, air from the enclosed space is drawn in from below the skirt 22 and passes, with minimal pressure drop, through the inlet muffler 26 and through the air moving device 28 to pass through the discharge muffler 30, again with minimal pressure drop, and exits through the conduit 64 to a location outside of the enclosed space.

In other environments, it is desirable to return air to the enclosed space, in a recirculating manner, rather than completely exhausting the air from the enclosed space. In such situations a slightly different arrangement is provided for the hood, although the same considerations are present, that is, the rate at which air is passed through the hood for recirculating will be at a certain predetermined level and it is desirable to have as low a noise and vibration emission from the hood as possible.

Figure 5:
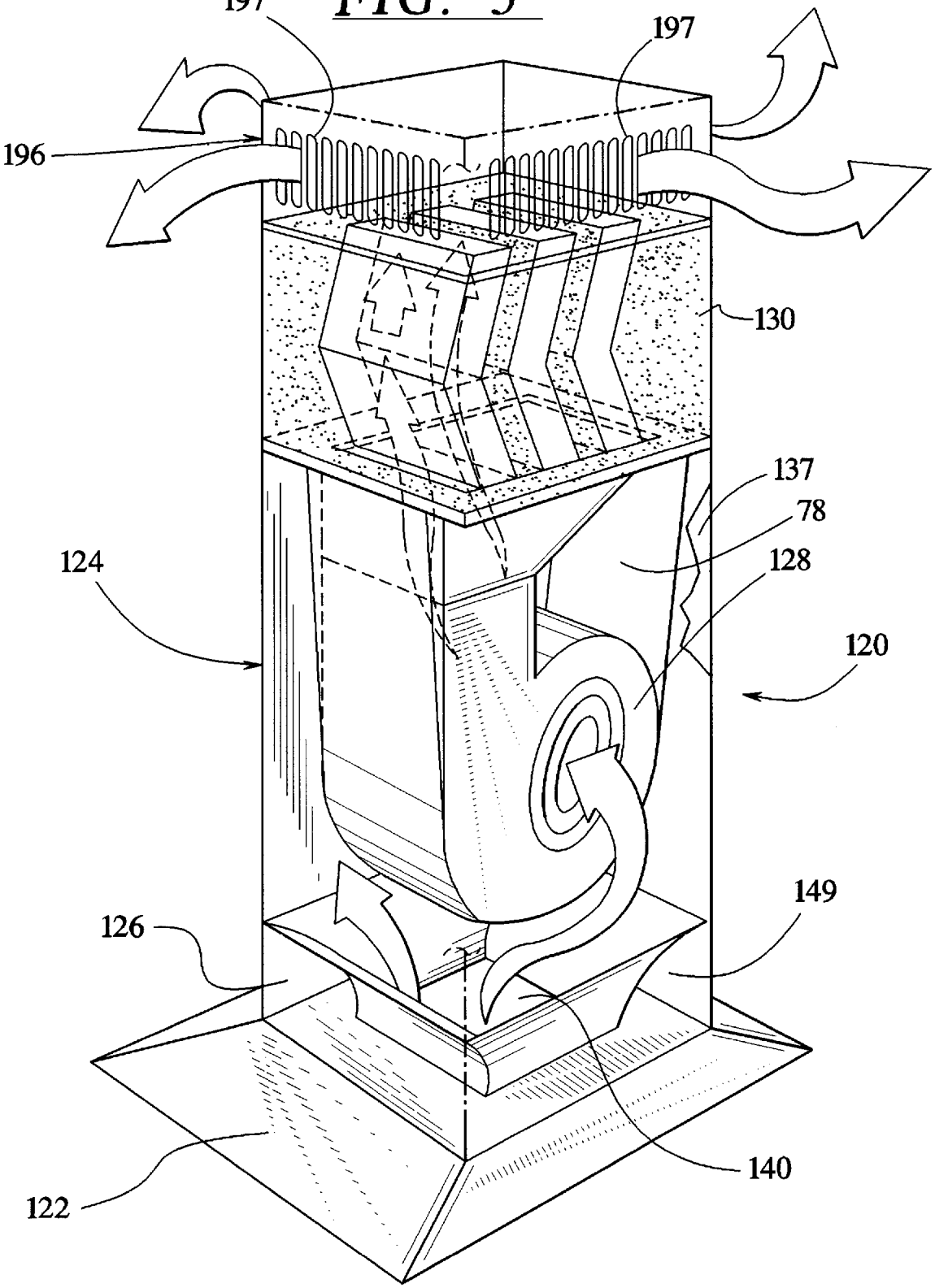
FIG. 5 is a side perspective view of a second embodiment of a hood embodying the principles of the present invention.

A particular embodiment of such a recirculating hood is shown at 120 in FIG. 5. In many respects the recirculating hood 120 is constructed in a similar manner to the exhaust hood 20 of FIGS. 1–4. Similar reference numbers, increased by 100 will be used to reference similar structures in the recirculating hood 120.

As in the embodiment shown in FIG. 1, the hood 120 includes a lower air collecting skirt portion 122 and a chimney portion 124. Also, in a preferred embodiment, the hood 120 is formed in a modular construction in which there is an intake diffuser 126, and an air moving device 128 and a discharge muffler 130 comprising the main modular components.

The chimney portion 124 may be constructed essentially identical to the construction as described with respect to the embodiment illustrated in FIG. 1.

Figure 6:
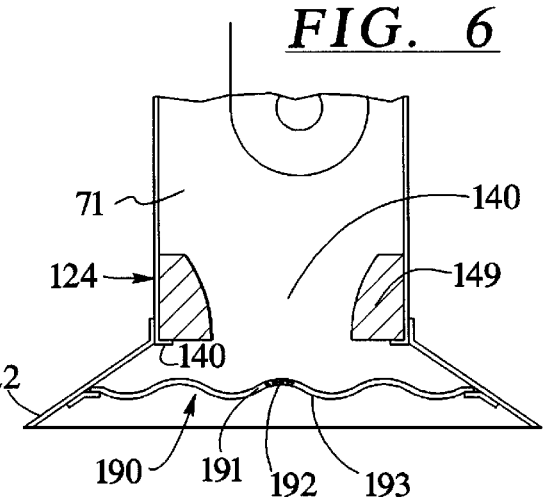
FIG. 6 is a side sectional view of an inlet filter for use with the hood of FIG. 5.

The intake diffuser 126 preferably is a self contained unit that can be inserted into the chimney framework to rest on a flange 140 formed at the bottom of the chimney framework 124 or at the top of the skirt portion 122 (FIG. 6). At least one air passageway 140 is provided through the inlet diffuser 126. In the embodiment, the intake diffuser 126 has an air passageway 140 that is very open and provides line-of-side path therethrough since other arrangements have been made, as discussed below to reduce the pressure drop and noise generation. Sound absorbing material 149 can still be used to form the walls of the air passageway 140 to absorb sound and vibration from the air moving device 128.

In this embodiment, however, since the air is to be re-circulated back to the room, an additional component is provided to filter or treat the air as a passes through the hood 120. Specifically, in the intake area within the skirt 122, there is provided a filter 190, and preferably a charcoal filter through which the intake air must pass. Traditionally in re-circulating hoods, the filter is provided in a container filled with granular charcoal which is placed in the bottom of the chimney portion of the hood. However, this results in a significant pressure drop, thus placing a greater demand on the air moving device. The present invention provides an arrangement for reducing the pressure drop in that a new charcoal filter structure 191 is provided which is placed in a different location than the typical placement. Preferably charcoal material 192 in the filter is a material sold by 3M Corp. under the name 3M Agglomerated Charcoal Filter. The charcoal material 192 is affixed to a supporting cloth 193, which allows maximum surface exposure and minimal pressure drop. The new design embodying the principles of the present invention uses the same quantity of the charcoal material as used in prior constructions, but only ¼ the thickness of the charcoal material as in previous constructions. Further, the location of the filter is moved from the bottom of the narrow chimney and into the more open skirt collector portion 122 of the hood 120. Thus, the area of the filter 191 used is about four times the area of a traditional filter. This allows the air flow through the filter to be reduced by about a factor of four and the pressure drop reduced by about a factor of sixteen.

A second important factor in reducing (FIG. 5) the pressure drop on the re-circulation hood 120 of the present invention is to increase the open area of a discharge grill 196. That is, in a recirculating hood there is a grill through which air is discharged after it leaves the discharge muffler 130. Typically a re-circulating hood 120 uses a limited number of holes of a somewhat restrictive size to return air to the enclosed space. In the present invention, the stainless steel cover 137 is provided with a larger number of holes 197 on all four sides thereof. By reducing the open space for the air to exit, the air velocity is reduced by about a factor of four over a standard grill which therefore reduces the pressure drop due to the grill by a factor of about sixteen. Hence, the reduced pressure drops through both the filter device 190 and the grill 196, permits the air moving device 128 to be operated at a much lower speed which, in turn, substantially reduces the sound and vibration generated by the air moving device. At the same time, the air flow through the hood 120 can be maintained at a rate at least as great as previously available hoods.

The discharge muffler 130 used in this embodiment is shown as being constructed similar to the intake muffler 126 of the embodiment shown in FIGS. 1–4. However, the discharge muffler 130 could also be constructed as shown for the discharge muffler 30 in FIGS. 1 and 3, or other constructions so that the requirements for air flow, pressure drop and vibration reflection and absorption described above are met.

Figure 7:
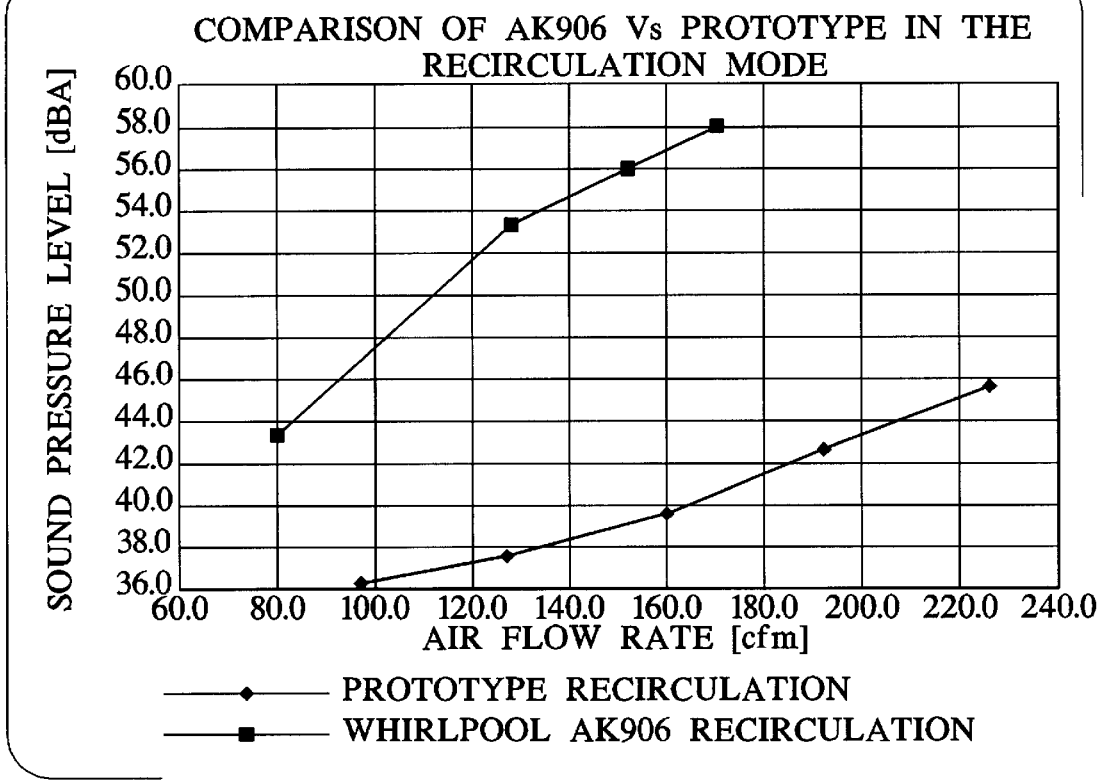
FIG. 7 is a graphic comparison of the noise level detectable from a commercially available recirculating hood and a hood as illustrated in FIG. 5.
Figure 8:
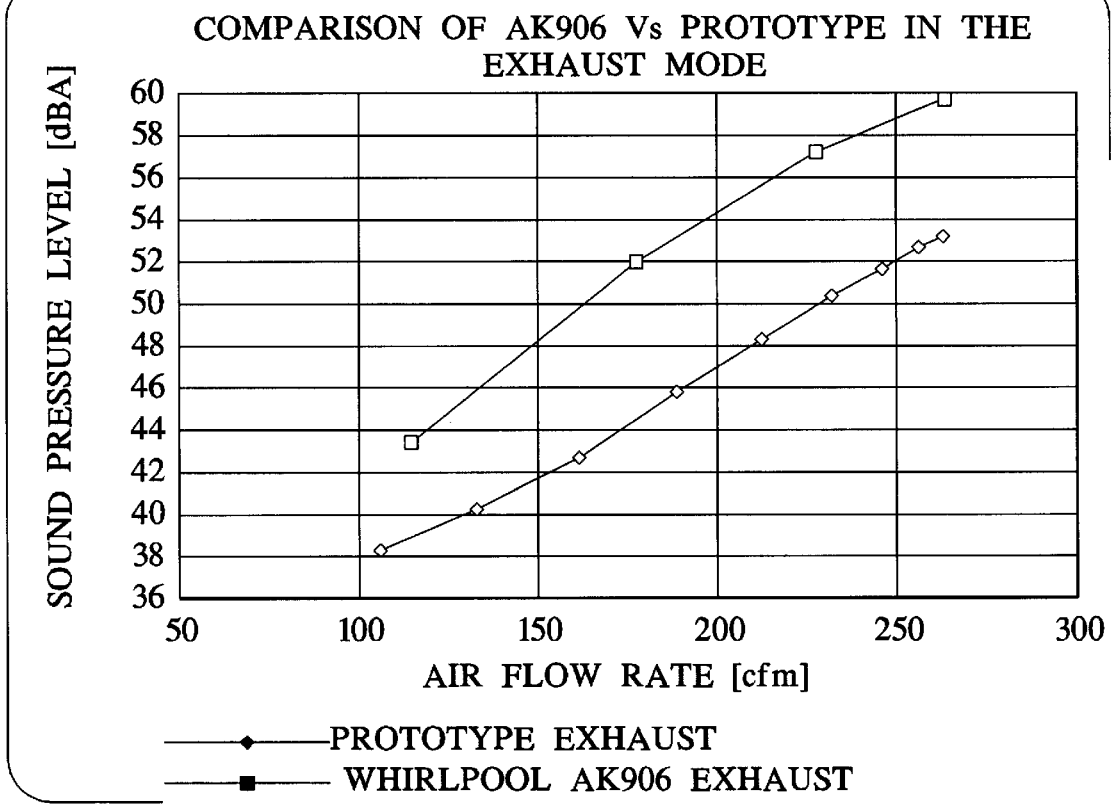
FIG. 8 is a graphic comparison of the noise level detectable from a commercially available exhaust hood and a hood as illustrated in FIG. 1.

FIGS. 7 and 8 illustrate the advantage of the present invention over a commercially available product. Specifically, in FIG. 7, a Whirlpool Model AK906 re-circulation hood is compared with a re-circulation hood built in accordance with the principles of the present invention present, in the embodiment of the hood as shown in FIG. 5. As illustrated, the sound pressure level in DBA is reduced substantially from the commercially available hood to the hood embodying the principles of the present invention for any given air flow rate. The sound pressure level drop range from more than 10 to more than 16 DBA over the range of air flow rates.

A similar result is achieved with respect to the exhaust hood embodiment. FIG. 8 is a graphic comparison of sound pressure levels in DBA versus air flow rate for a commercially available AK906 exhaust hood and an exhaust hood made in accordance with the present invention, in the embodiment illustrated in FIG. 1. Again, for every flow rate the drop in sound pressure level is at least 4 to 6 DBA.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A low noise hood comprising:

a housing having an air inlet and an air outlet;

a first device with a first air duct passage extending therethrough mounted within said housing near said air inlet;

a second device with a second air duct passage extending therethrough mounted within said housing near said air outlet;

said second air duct passage shaped to prevent a straight unobstructed path through said second air duct passage;

a third device comprising an air moving device secured by a mounting arrangement within said housing;

a first vibration isolator in said mounting arrangement for said air moving device; and a second vibration isolator positioned between said air moving device and said second air duct passage.

2. A low noise hood according to claim 1, further including a third vibration isolator positioned between said second device and said housing.

3. A low noise hood according to claim 2, wherein said third vibration isolator comprises a resilient mounting member.

4. A low noise hood according to claim 1, wherein said first device comprises a modular intake muffler with at least one air flow passage therethrough constructed to prevent line-of-sight path therethrough.

5. A low noise hood according to claim 4, wherein said at least one air flow passage comprises a plurality of channels extending from a bottom face to a top face of said muffler, each channel arranged at an angle to said faces, and having at least one bend along a length thereof.

6. A low noise hood according to claim 1, wherein said second device comprises an outlet muffler with at least one air flow passage therethrough constructed to prevent line-of-sight path of air therethrough.

7. A low noise hood according to claim 6, wherein said at least one air flow passage comprises a plurality of channels extending from a bottom face to a top face of said muffler, each channel arranged at an angle to said faces, and having at least one bend along a length thereof.

8. A low noise hood according to claim 6, wherein said at least one air flow passage comprises a single passage through said muffler and at least one baffle is arranged in said passage.

9. A low noise hood according to claim 1, wherein said third device comprises a motor driven air moving device having an air inlet arranged to receive air from said first device and an air outlet arranged to discharge air to said second device.

10. A low noise hood according to claim 1, wherein said first vibration isolator comprises a plastic saddle device constructed to receive and carry said air moving device and to secure it to said second device in a suspended manner.

11. A low noise hood according to claim 1, wherein said second vibration isolator comprises a flexible connecting member attached at one end to an air outlet of said air moving device and at an opposite end to an air inlet of said second device.

12. A low noise hood according to claim 1, wherein said first device comprises a filter member and an intake muffler.

13. A low noise hood comprising:

a housing with a first end and a second end, said housing having an air inlet at said first end and an air outlet at said second end;

an intake muffler with a first air duct passage extending therethrough positioned within said housing near said first end;

said first air duct passage shaped to prevent a straight unobstructed path for through said first air duct passage;

said first air duct passage including vibration absorbing materials therein;

a discharge muffler with a second air duct passage extending therethrough positioned within said housing near said second end;

said second air duct passage shaped to prevent a straight unobstructed path through said second air duct passage;

said second air duct passage including vibration absorbing materials therein;

an air moving device positioned within said housing between said intake muffler and said discharge muffler;

a first air flow passage extending between said first air duct passage and said air moving device and a second air flow passage extending between said air moving device and said second air duct passage;

a first vibration isolator positioned between said housing and said air moving device; a second vibration isolator positioned between said air moving device and said discharge muffler;

said second vibration isolator comprising a flexible material forming a portion of said second air flow passage.

14. A low noise hood according to claim 13, wherein said first vibration isolator comprises a vibration absorbing material positioned between said air moving device and said discharge muffler comprising a plastic sheet forming a saddle for carrying and supporting said air moving device from said discharge muffler.

15. A low noise hood according to claim 13, including a third vibration isolator positioned between said second modular device and said housing, said third vibration isolator comprising a resilient material positioned between said exhaust muffler and said housing wherein said resilient material of said third vibration isolator is in the form of grommets.

16. A low noise hood according to claim 13, wherein said second air duct passage comprises a single passageway having a plurality of bends therein.

17. A low noise hood according to claim 13, wherein said intake muffler, said discharge muffler, and said air moving device comprise modular members securable to said housing as separate members.

18. A low noise hood comprising:

a housing with a first end and a second end, said housing having an air inlet at said first end and an air outlet at said second end;

an intake muffler with a first air duct passage extending therethrough positioned within said housing near said first end;

said first air duct passage shaped to prevent a straight unobstructed path flow through said first air duct passage;

said first air duct passage further comprising a filter device positioned between said first end and said first modular device;

a discharge muffler with a second air duct passage extending therethrough positioned within said housing near said second end;

said air duct passage shaped to prevent a straight unobstructed path through said second air duct passage and including vibration absorbing materials therein;

an air moving device positioned within said housing between said intake muffler and said discharge muffler;

a first air flow passage extending between said first air duct passage and said air moving device and a second air flow passage extending between said air moving device and said second air duct passage;

a first vibration isolator positioned between said housing and said air moving device;

a second vibration isolator positioned between said air moving device and said discharge muffler;

said second vibration isolator comprising a flexible material forming a portion of said second air flow passage; and an exhaust outlet positioned at said air outlet;

said exhaust outlet comprising a plurality of openings through said housing to provide a large open area and to reduce a pressure drop through said outlet.

19. A low noise hood according to claim 18, wherein said filter device comprises a flexible air permeable material obstructing said air duct passage and supporting a thin filter material extending across a large area of said air inlet.

20. A low noise hood according to claim 18, wherein said air duct passage comprises a plurality of passageways having at least one bend therein to prevent a straight line passage from one end to the other therethrough.

21. A low noise hood according to claim 18, wherein said first vibration isolator comprises a vibration absorbing material positioned between said air moving device and said discharge muffler comprising a plastic sheet forming a saddle for carrying and supporting said air moving device from said discharge muffler.

22. A low noise hood according to claim 18, further including a third vibration isolator positioned between said second module and said housing, said third vibration isolator comprising a resilient material positioned between said exhaust muffler and said housing.

23. A method for venting exhaust in an air stream comprising:

providing a housing having an air inlet for receiving said air stream and an air outlet for discharging said air stream, an air moving device between said air inlet and said air outlet and an air flow path between said air inlet and said air outlet;

directing said air stream through a first air passage from said inlet to said air moving device in a manner so as to substantially reduce a transmission of sound from said air moving device to said inlet;

directing said air stream through a second air passage from said air moving device to said air outlet in a manner so as to substantially reduce a transmission of sound from said air moving device to said outlet;

absorbing sound vibrations carried by said air stream as it flows through said second passage;

absorbing vibration between said housing and said air moving device; and absorbing vibration between said air moving device and said second air passage.

24. A method for venting exhaust in an air stream according to claim 22, wherein said air is directed through said first air passage by shaping said first air passage to prevent a straight unobstructed path through said first air passage.

25. A method for venting exhaust in an air stream according to claim 22, wherein said air is directed through said second air passage by shaping said second air passage to prevent a straight unobstructed path through said second air passage.

26. A method for venting exhaust in an air stream according to claim 22, further including the step of absorbing vibration between said air outlet and said housing.

27. A method for venting exhaust in an air stream according to claim 22, including the steps of drawing air from an enclosed space into said air moving device and exhausting said air from said air moving device through said air outlet back into said enclosed space.

* * * * *